United States Patent [19]

Miller

[11] 4,060,867

[45] Dec. 6, 1977

[54] INFLATABLE LIFE VEST

[75] Inventor: David D. Miller, Miami Springs, Fla.

[73] Assignee: American Safety Equipment Corporation, Encino, Calif.

[21] Appl. No.: 716,827

[22] Filed: Aug. 23, 1976

Related U.S. Application Data

[63] Continuation of Ser. No. 535,950, Dec. 23, 1974, abandoned.

[51] Int. Cl.[2] ..... B63C 9/16

[52] U.S. Cl. ..... 9/313

[58] Field of Search ..... 9/14, 311, 313, 314, 9/316, 322, 329, 336, 337–342

[56] References Cited

U.S. PATENT DOCUMENTS

| | | | |
|---|---|---|---|
| 2,046,335 | 7/1936 | Manson | 9/336 |
| 2,128,423 | 8/1938 | Manson | 9/342 |
| 2,621,342 | 12/1952 | Boyle | 9/336 |
| 3,329,982 | 7/1967 | Zannoni | 9/338 |

*Primary Examiner*—Trygve M. Blix
*Assistant Examiner*—Jesus D. Sotelo
*Attorney, Agent, or Firm*—Poms, Smith, Lande & Glenny

[57] ABSTRACT

In a double-tubed life vest with the inside marginal edges of the tubes fastened to each other temporary connecting members on the tubes releasably hold the outside marginal edges of the tubes together. The temporary connecting members are released when the gas pressure in the vest is greater than a given pressure. The gas occupies a first volume when the temporary connecting members are holding the corresponding sections of the tubes together such that the first volume of gas at the first pressure provides sufficient buoyancy to the life vest to support a body. The gas can occupy a second volume when the temporary connecting members are released to allow the gas to occupy a greater volume such that the addition of more gas in the tubes provides greater buoyancy to the body.

10 Claims, 9 Drawing Figures

Fig. 4.
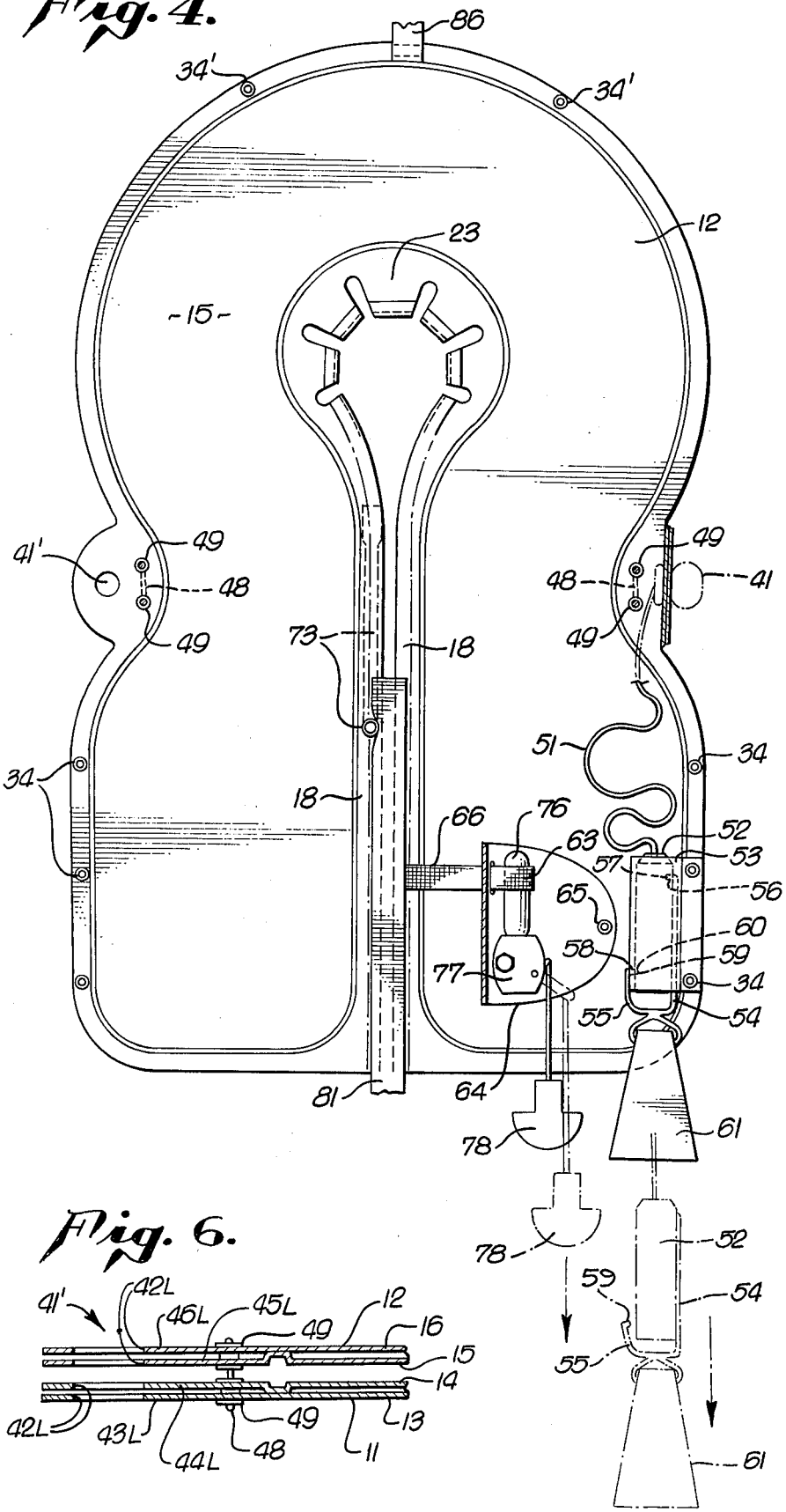
Fig. 5.
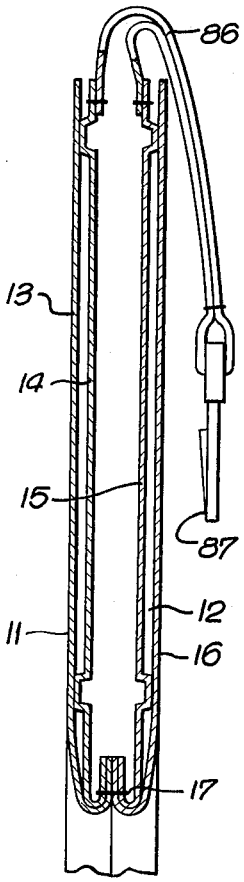
Fig. 6.

INFLATABLE LIFE VEST

This is a continuation of application Ser. No. 535,950, filed Dec. 23, 1976 now abandoned.

BACKGROUND OF THE INVENTION

Life vests are provided on ships and airplanes as a safety feature in case of an airplane crash into water or a ship's sinking. Such devices are normally adapted to be placed over the user's head and depend from his neck along his chest and abdomen. Such vests are usually provided with a gas supply in the form of a sealed gas cylinder which is adapted to provide sufficient gas to the vest quickly. The sufficient amount of gas is intended to be that which will provide enough buoyancy to the user to maintain his head out of the water. Generally, 23 lbs. of buoyancy is enough to compensate for the lack of sufficient natural buoyancy in the person to maintain his head out of the water. However, in heavy waves the user's momentum going between the peaks and troughs of the waves is often sufficient to momentarily submerge his head. As the height of the waves is increased, the chances of drowning are also increased as the length of time with the head under the water is increased. Moreover, merely submerging the head briefly can have the effect of disorienting the user and this may increase his chances of becoming separated from other crash or shipwreck survivors. These problems are greatly increased if the user is injured or unconscious.

Dual chambered life vests are often provided as an additional safety feature. If one chamber fails, some buoyancy will remain in the other chamber to assist in maintaining the user's head out of the water. Another safety feature often incorporated in life vests is an oral inflating tube. These tubes are provided in case of failure of the gas cartridge to supply sufficient gas to inflate the vest, and the air tube is also a source of air in case of a slow leak in the vest's chamber.

In order to provide more buoyancy in a life vest, the volume can be increased. However, the additional buoyancy yielded from a larger vest is often not needed. It is advantageous that the life vest be completely filled in order that the vest provide sufficient support about the neck. Obviously, if a larger volume vest were used and the amount of buoyancy were to be decreased, the pressure in the life vest would be decreased and this would result in the loss of support about the neck. Therefore, it would be advantageous to have a life vest which would be fully pressurized at two different buoyancies.

As mentioned above, it is advantageous to have a dual chambered life vest. However, because of the force exerted between chambers, it is difficult to bend the vest to conform it to the front of the user. Conforming the vest to the user's front is important to ensure the proper attitude of the user's body in the water. As many vests are provided with straps extending from the bottom of the vest and going around the user, if the bottom of the vest is closer to the user, the amount of strap needed with each vest is decreased and results in an overall savings in the cost of each life vest.

Many life vests are provided with small lights which are electrically connected to water actuated batteries. The lights are useful at night to indicate the user's location to potential rescuers and to fellow survivors. Many such batteries are mounted directly to the underside of the vest. In that location, the batteries constantly remain in the water. If the user activates the battery at night but there is still usable power in the battery at dawn, there is no way to conserve that energy.

As stated above, life vests have auxiliary oral tubes in order to provide a supplementary source of air. It is advantageous that the auxiliary tubes be kept out of the way during donning of the vest so as not to interfere with the head of the user. It is also important that the tubes be easily accessible both to the user and to another person who might have to inflate the vest if the user is unable to do so.

One relatively minor safety problem occurring with life vests concerns the situation when the user fills the vest with air using the oral tube and then accidentally actuates the gas cylinder. In that case, the vest could become overpressurized and burst.

Therefore, the main object of the present invention is to overcome the above mentioned difficulties occurring in prior life vests. Specifically, it is an object of the present invention to provide a life vest with two amounts of buoyancy, each level of buoyancy occurring when the life vest is rigid from full pressurization. In accomplishing this object, the other object of providing a safety release for subsequent gas cylinder actuation after prior oral inflation is also accomplished. Another object of the invention is to have a dual chambered life vest which conforms to the user's chest and abdomen while the vest is around his neck. Another object is to provide a battery mounting with which the battery can be removed from the water during daylight hours to prevent the total depletion of available power therein. Other objects will become evident in the remaining portion of the specification.

SUMMARY OF THE INVENTION

Temporary connecting means are provided on the life vest to releasably hold corresponding sections of each of two chambers together. The temporary connecting means are released when the gas pressure in the life vest is greater than a first pressure. The gas in the life vest occupies a first volume when the temporary connecting means is holding the chambers together such that the first volume of gas at the first pressure provides sufficient buoyancy to support the body. The gas in the life vest occupies the second volume when the temporary connecting means is released to provide a greater volume of gas in the life vest such that the addition of more gas in the life vest provides greater buoyancy to the body. Light holding means are provided for holding an emergency light near the outside portion of the vest. A fastener near the outside marginal edge of both tubes or chambers permanently fastens a section of the tubes together near the light holding means and prevents the temporary connecting means from releasing the area near the light holding means so that the emergency light is retained within the light holding means when the temporary connecting means is released, and whereby the tube means are bent about the fastener for enabling the life vest to better conform to the body of the user. The light holding means includes at least one pair of tabs; each tab is formed integrally with one wall of each tube, has an aperture therethrough. The tabs are folded inwardly over each other so that the apertures are realigned for receiving the emergency light within the apertures. A water activated battery is releasably held on the vest and connected by wire to the light. The wire is long enough so that when the means which releasably holds the battery is released, the battery will fall into the water. An inside marginal portion is formed from an inward extension of at least one wall of each tube. Oral delivery means has one end extending through one extension of the marginal portion and into the tube associated with the other extension whereby introduction of air into the oral delivery means inflates the tube. A slit is provided on the inside marginal portion for receiving the other end of the oral delivery means to maintain that end in a location where it does not interfere with donning of the life vest and where it is near the mouth of the person.

BRIEF DESCRIPTION OF THE DRAWINGS

FIG. 4 is a cutaway front view of the life vest incorporating the improvements of the present invention. The front tube means are removed to show the storage of the gas cylinder and the battery within the life vest.

FIG. 5 is a sectional view through the plane V—V in FIG. 1 and shows how the strap of the harness is connected to the upper portion of the life vest.

FIG. 6 is a sectional view taken along the plane VI—VI in FIG. 1 and shows the other light holding means without a light therein.

DETAILED DESCRIPTION OF THE PREFERRED EMBODIMENTS

Figure 7:
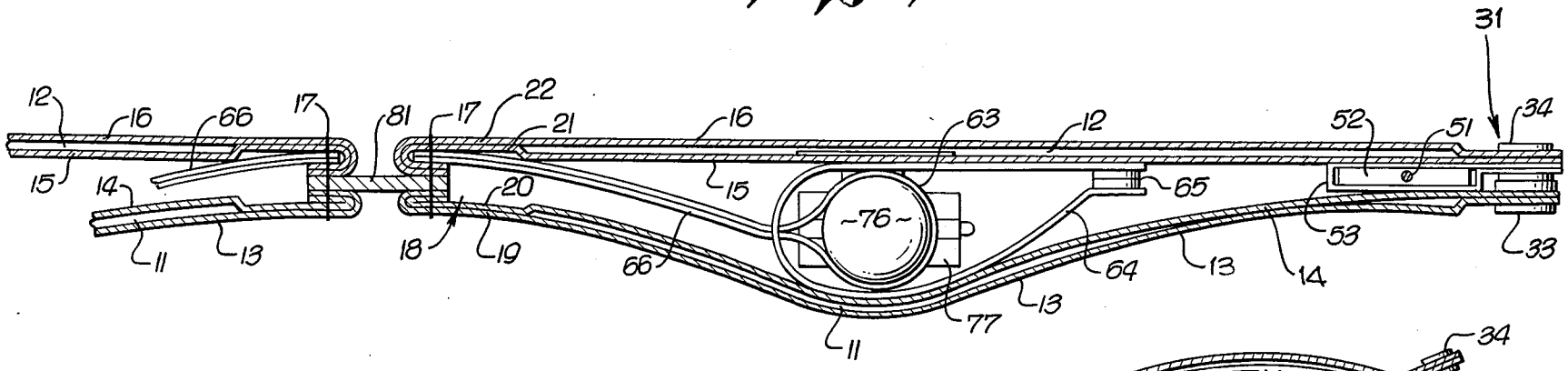
FIG. 7 is a sectional view taken along the plane VII—VII in FIG. 1 and shows the vest in a deflated condition.
Figure 9:
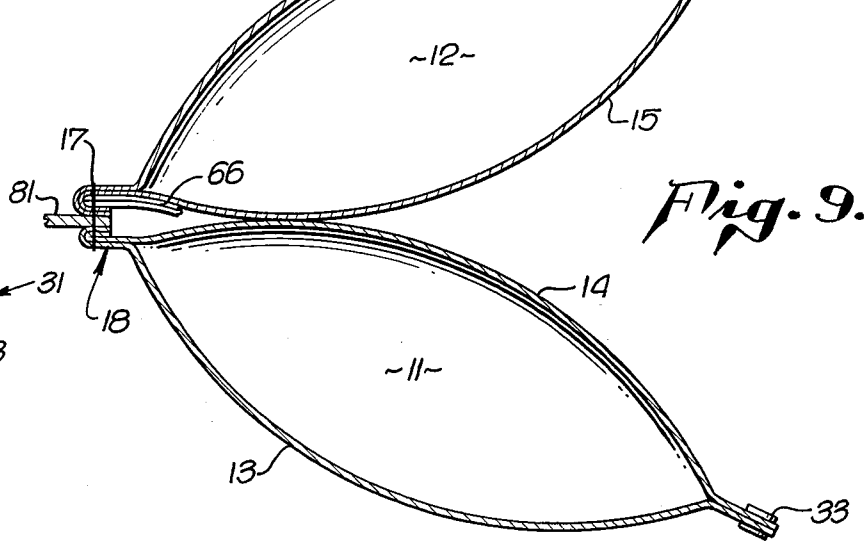
FIG. 9 is a view similiar to FIG. 8 after release of the temporary connecting means and shows the vest in an inflated condition. For clarity in FIG. 8 and 9, the accesories between the tubes are not shown.
Figure 8:
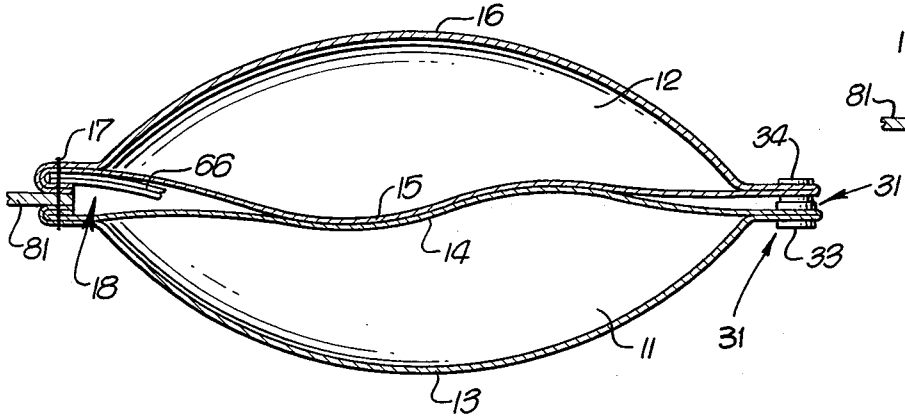
FIG. 8 is a cross sectional view taken through the plane VII—VII in FIG. 1 and shows the vest in an inflated condition prior to release of the temporary connecting means.

The life vest of the present invention includes buoyancy means 10 to support the body of a person. Gas supply means supplies gas to the interior of the buoyancy means. The buoyancy means comprises front tube means 11 and rear tube means 12 (FIGS. 7, 8 and 9). In the exemplary embodiment, the tube means are generally U-shaped. Each tube has a front and rear wall. The front and rear walls of the front tube are indicated by the reference numberals 13 and 14, respectively, and the front and rear walls of the rear tube are indicated by the reference numerals 15 and 16, respectively. The front and rear walls of each tube are connected together along the marginal edges thereof in an airtight manner. In the exemplary embodiment, this is done by a heat seal.

The rear tube and the front tube are connected together. In the exemplary embodiment, the connection is adjacent the inside marginal edges of the tubes. As shown in FIGS. 5, 7, 8 and 9 of the exemplary embodiment, the tubes are connected together near their inside marginal edges by sewing stitches 17. In FIG. 7, the stitches are also attached to webbing 81 which is part of the harness means 80. (See also FIG. 1).

Figure 1:
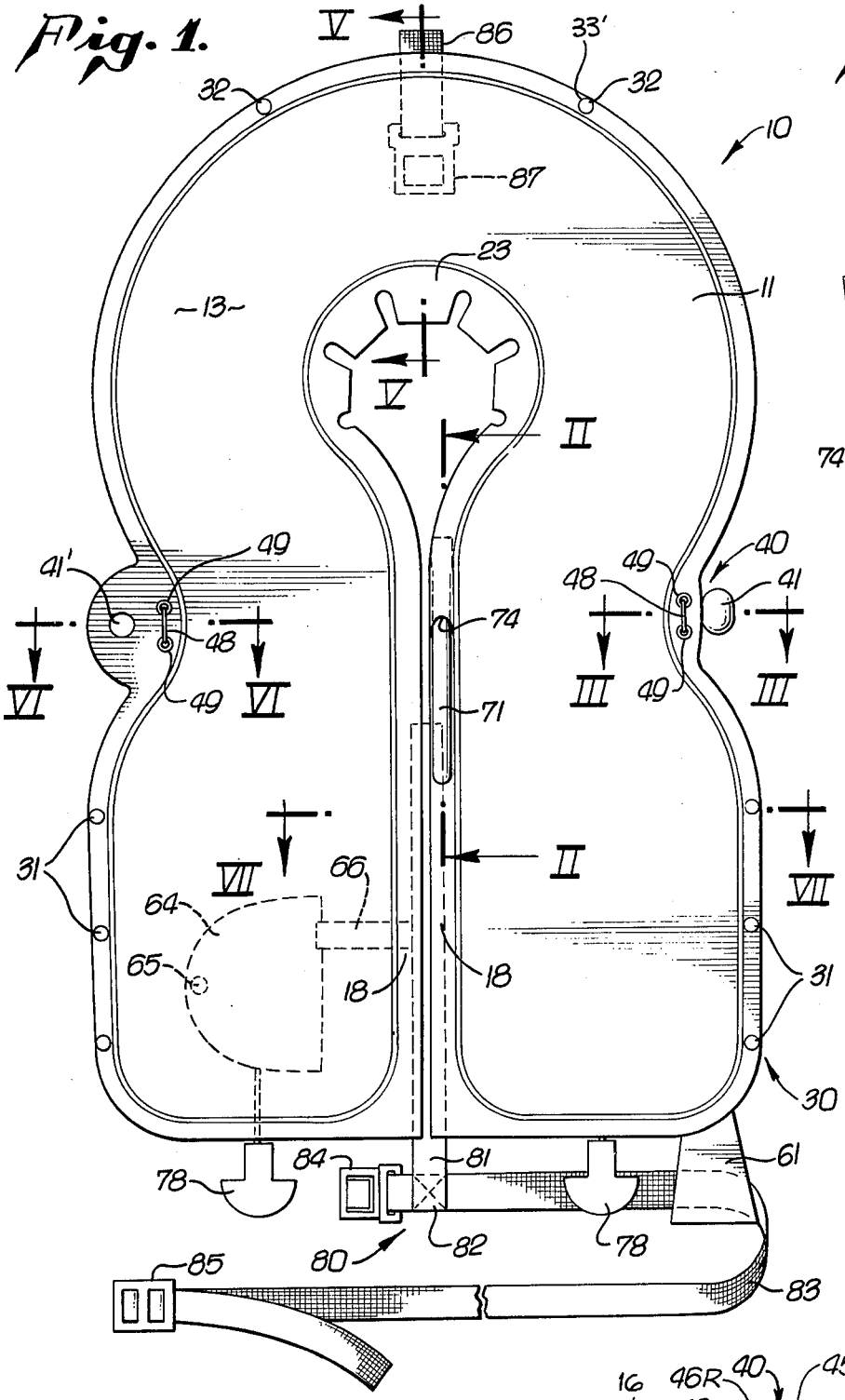
FIG. 1 is a front view of the life vest incorporating the improvements of the present invention.

Temporary connecting means on the tube means releasably holds corresponding sections of the tube means together. In the exemplary embodiment, the temporary connecting means 30 includes a plurality of snaps, the snaps on the lower outside portion being designated by the reference numeral 31 and the snaps on the upper outside portion being designated as 32. (FIG. 1). Snaps 31 comprise female member 33 and male member 34, and the upper snaps 32 also include a female member 33' and a male member 34'.

The temporary connecting means being sufficiently strong to remain connected when the gas pressure in the buoyancy means is less than the first pressure is released when the gas pressure in the buoyancy means is greater than a first pressure. Referring to FIG. 8, gas has entered both tube means 11 and 12 and walls 13 and 16 are stretched to their greatest possible extent. It should be noted that walls 14 and 15 are not stretched to their greatest extent, but are somewhat folded up between the permanent connection of the tube means at stitches 17 and the temporary connecting means at the snap 31. As the pressure increases, a force is exerted on the snap 31 until the resistance of the snap 31 to unsnap is overcome. Thereafter, the tube means assume the FIG. 9 position, and as more air of gas enteres the respective tube means, all of the walls of the tube means are stretched to their fullest extent.

The improvement of the present invention includes the provision of having the life vest designed so that the configuration in FIG. 8, there is sufficient buoyancy to support the user. When the snaps are released and walls 14 and 15 are allowed to stretch to their fullest extent allowing a greater volume of air in the life vest, the buoyancy may be increased to prevent the user's head from bobbing up and down in the water.

In the exemplary embodiment in FIG. 8, the inside walls 14 and 15 are folded over each other and the amount of folding is determined by the amount of material in the inside walls. By controlling the amount of material in the inside walls, the larger buoyancy value is controlled. For example, if walls 14 and 15 were lengthened, the gas volume in FIG. 8 would remain relatively constant but the available volume in FIG. 9 would be increased.

Because the cross-sectional area of the tubes is different in the lower portion than it is about the neck, and because it may be desirable to have the snaps 32 open at a different tube pressure than the pressure at which snaps 31 open, different types of snaps with different opening resistances may be provided at the respective locations.

Light holding means for holding an emergency light near the outside portion of the buoyancy means are provided. The light holding means includes at least one pair of tabs. Each tab is formed integrally with one wall of each tube means, and each tab has an aperture therethrough. The tabs are folded inwardly over each other so that the apertures are aligned for receiving the emergency light within the aperture of the tabs.

Figure 3:
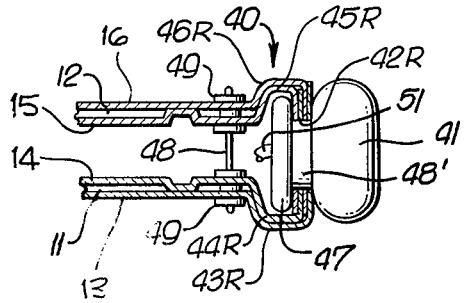
FIG. 3 is a sectional view taken through the plane III—III in FIG. 1. It shows in detail the manner in which the light holding means holding the emergency light.

In the exemplary embodiment, the light holder 40 holds the emergency light 41. Although only one emergency light 41 is shown, it may be desirable to mount a second emergency light on the other side of the life vest at location 41'. It should be noted that the walls of the tube means are symmetrical and are the same size and shape. FIG. 3 shows the emergency light 41 mounted in the light holding means, and FIG. 6 shows the unused light holding means 41'. Because the light holding means are mirror images of each other, the description of the light holding means prior to insertion of an emergency light will be described with reference to the unused light holding means 41', and the reference numerals on the drawings will include the letter "L" to indicate the left side. Likewise, the completed light assembly will use reference numerals terminating in "R" to indicate the right side of the drawing. In the exemplary embodiment, each wall of the tube has a tab extending outwardly therefrom, tab 43 extending from wall 13, tab 44 extending from wall 14, tab 45 extending from wall 15 and tab 46 extending from wall 16. Each tab has an aperture 42 therethrough.

In order to insert the emergency light 41, the tabs are folded inwardly over each other so that the apertures are aligned for receiving the emergency light within the apertures of the tabs. In the exemplary embodiment, an inside tab 44 or 45 would first be folded inwardly and then the remaining inside tab would be folded over the first folded tab. Thereafter, the outside tab 43 or 46 associated with the tube means associated with the first folded tab would then be folded over the two inside tabs, and the remaining tab would then be folded over the three folded tabs. After the apertures 42 are aligned, the emergency light 41 is pushed through the aligned apertures 42. It should be recognized that when the wide portion 47 of the bulb is pushed through the apertures, the apertures can elongate to allow the wide portion 47 to pass. Thereafter, the round aligned apertures 42 seat against the narrow portion 48' of bulb 41, and the opposing pull from the tabs from the opposing tubes is relatively balanced to maintain light 41 in a straight orientation.

The tabs do not have to be folded over each other in the manner described above, but could be folded in any order. However, if both tabs extending from one tube are folded together and the tabs from the other tube are folded over the first two tabs, there may be a twisting imparted to the emergency light when the tubes are inflated causing the tabs to pull against each other.

Fastening means are provided near the outside marginal edge of both tube means for permanently fastening a section of the tube means together near the light holding means and for preventing the temporary connecting means from releasing the area near the light holding means so that the emergency light is retained within the light holding means when the temporary connecting means is released and whereby the tube means are bendable about the fastening means for enabling the life vest to better conform to the body of the user. In the preferred embodiment, the fastening means includes heavy duty thread 48, wire, or the like which is looped through four grommets 49, two on each tube. See FIGS. 1, 3, 4 and 6. When the temporary connecting means 31 and 32 are released, the outside marginal edges of the tubes near the emergency light will not separate because of the permanent connection caused by the fastening means 48 and the tabs. Therefore, the portion of the tube running between the fastening means 48 on both sides of the life vest cannot become fully inflated, and they will not resist bending as well as the more fully inflated parts of the tubes. Consequently, when the harness about the bottom of the vest is tightened, the bending that can occur generally through the plane connecting the two fastening means 48 allows the life vest to better conform to the body of the user. This feature improves the angle with which the body is maintained in the water.

A water activated battery is activated when in the water. Means are provided for holding the battery on the vest, and electrical current carrying means electrically connect the battery with the light. The electrical current carrying means is long enough so that when the means releasably holding the battery is released, the battery falls into the water.

As mentioned above, one problem of many prior art life vests was that the battery was permanently attached to the life vest so that when the battery became activated, it could not be deactivated. In the preferred embodiment of the present invention, wire 51 carries current from the water activated battery 52 to the emergency light 41. There is an excess of wire sufficient to allow the battery to hang in the water (dotted line position in FIG. 4) while electrically connected to the emergency light 41.

The means releasably holding the battery comprises a pouch having an open bottom for permitting the battery to be removed therefrom. The pouch is of such a size that the battery is held therein but may be removed by applying a given force. The battery has a pair of holes therein, and the pouch has a hole therethrough so located that the hole in the pouch is aligned with one of the holes in the battery. Pulling means are attached to the battery for pulling the battery from the pouch. The pulling means has two arms, each arm terminating in a plug. One arm extends inside the pouch and the plug on that arm extends into one hole in the battery. The other arm extends outside the pouch, and the plug on the other arm extends through the aligned holes in the pouch and battery to maintain the battery within the pouch. When the battery is pulled, the plug extending through the aligned holes in the pouch and battery is released from its holes to release the battery and the other plug pulls the battery out of the pouch. With one or both plugs removed from the battery holes, water is allowed to enter the battery and activate it.

Referring now to FIG. 4 of the exemplary embodiment, the battery 52 is held within the pouch 53. The pouch is mounted to the outside marginal portion of one tube and is held thereon by at least one snap member. As shown in FIG. 4 in the exemplary embodiment, the male members 34 which are riveted through the outside marginal portion of tube 12 also rivet the pouch to the outside marginal portion. The pulling means includes two arms 54 and 55. Arm 54 extends inside the pouch and a plug 56 extends into a hole 57 in the battery. When plug 56 is in hole 57, water is prevented from entering hole 57 to activate the battery.

Arm 55 extends along the outside of the pouch and plug 59 extends through hole 58 in the pouch and hole 60 in the bottom portion of the battery.

The pulling means includes a tab 61 which is connected to the other parts of the pulling means, and the tab extends below the bottom of the vest. When the user desires to activate the light 41, he pulls downwardly on the tab 61. The downward force on the battery causes the holes 58 and 60 to become unaligned and plug 59 is pulled from the holes. Continued pulling on the tab 61 causes the plug 56 acting through arm 54 to remove the battery from the pouch. (See phantom line position for tab 61 in FIG. 4).

The water is free to enter hole 60 and activate the battery. To allow the battery to completely fill with water, plug 56 should also be removed from hole 57. If the user desires to discontinue use of the emergency light 41 to conserve it for a later use, he can lift the battery out of the water and let the water therein drain out. Then the plugs 59 and 56 are pushed into their respective holes 60 and 57 in the battery if the pulling means has not been discarded. Alternatively, the battery may be pushed through the pouch and placed between walls 14 and 15 near the light holding means where the pressure exerted from both tubes would hold the battery and prevent it from falling back into the water.

As discussed above, the inside marginal portion of the vest comprises the extension of the side walls on each tube means being sewn together. Oral delivery means have one end extending through one extension of the inside marginal portion and into the tube means associated with the other extension of the inside marginal portion whereby the introduction of air into the oral delivery means inflates the tube means. In the exemplary embodiment, the inside marginal portion is indicated generally at 18 (FIGS. 1, 7, 8 and 9) and extends upward along the inside of the vest, about the neck portion 23 and down the other inside portion of the vest. The marginal portion 18 comprises extension 19 (FIG. 7) integrally formed with wall 13, extension 20 with wall 14, extension 21 with wall 15, and extension 22 with wall 16.

Figure 2:
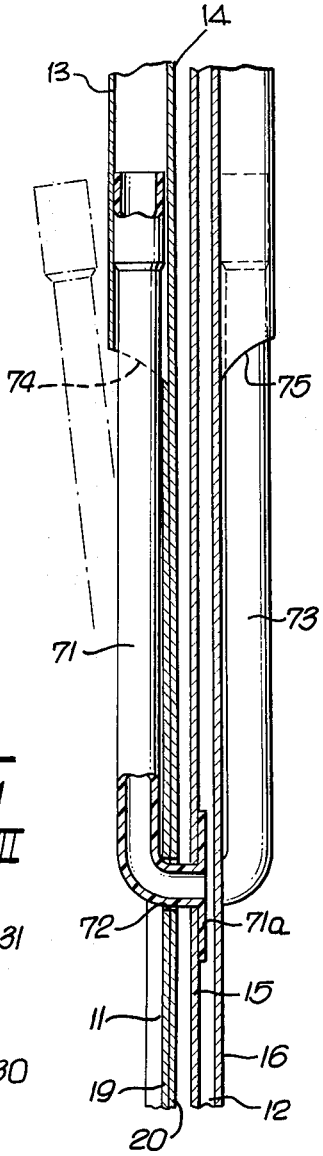
FIG. 2 is a sectional view taken along the plane II—II in FIG. 1 and shows the manner in which one end of the oral tube enters one chamber and also shows the slit in which the other end of the oral tube is stored.

As shown more clearly in FIG. 2 of the exemplary embodiment, the oral delivery means comprises an oral tube 71 which extends through aperture 72 through the inside marginal portion formed from extensions 19 and 20. The oral tube then passes through wall 15 of tube 12 and it is secured therein by means of a washer or plate 71*a*. Blowing through the oral tube 71 would introduce air into the tube means 12 to inflate the rear tube means 12. In a similar fashion, oral tube 73 passes into front tube means 11 so that blowing into oral tube 73 inflates the front tube means 11.

Referring to FIG. 1 of the exemplary embodiment, it is noted that oral tube 71 extends along the inside marginal portion of the vest. As shown in phantom in FIG. 4, oral tube 73 extends parallel to oral tube 71 along the rear side of the marginal portion. Slit means in the inside marginal portion receive the upper end of the oral delivery means to maintain the oral delivery means in a location where it does not interfere with donning of the life vest and where it is near the mouth of the person. In the exemplary embodiment, slit means 74 is cut in extension 19. (FIGS. 1 and 2). Oral tube 71 is made of flexible material and can be bent to remove the upper end of the oral tube from its location nested between extensions 19 and 20. Likewise, slit 75 receives the upper end of oral tube 73. (FIG. 2).

The slits are so located that the oral tubes are maintained in a generally upright orientation which positions the oral tubes near the mouth of the user and also prevents rotation of the oral tube in its fitting through tube wall 15. When the oral tube is not within the slit, its resiliency will maintain it in a position similar to that shown in phantom in FIG. 2. In that position, the user can easily reach with his mouth the upper end of the oral tube 71. Even though oral tube 73 is on the inside of the life vest, it is still equally accessible to the user's mouth. A check valve or other valve is provided in each oral tube to prevent air or gas from being released out the oral tubes.

It should be recognized that the oral tubes are supplemental or auxiliary gas supply means for the vest. The primary source of gas is the gas cartridge 76 which is actuated by jerking tab 78 which activates the actuation means 77. (FIG. 4).

Referring now to FIG. 7, the gas cartridge 76 is connected by a fitting 63 to the interior of rear tube means 12. Another gas cartridge is connected to a similar fashion to tube means 11. The gas cartridge 76 and the actuator 77 are mounted in a pouch 64 which has a snap fastener 65 to permit access therein. A loop 66 is around the cartridge 76, and the loop is sewn to the vest's inside marginal portion 18 after it passes through an aperture in the pouch 64. The combined support from the pouch 64 and the loop 66 prevents movement of the gas cartridge 76. If maintenance is required in the gas cartridge or actuator, the pouch is opened at the snap and the gas cartridge is easily accessible.

If one or both gas cartridges or actuators malfunction, if the user does not know that he should actuate both cartridges, or if he does not know of the gas cartridges all together, and if he were to orally inflate a standard life vest and then actuate the gas cartridges, the excess pressure within a vest may rupture the gas chambers. In the present invention, however, if the oral tubes are used to inflate the vests to the FIG. 8 condition, a later unintentional actuation of the gas cartridges would merely supply sufficient pressure to release the temporarily connecting means and allow the vest to assume the FIG. 9 configuration. This added safety feature is an important part of the present invention.

Harness means are provided to secure the vest to the body of the user. The harness means includes a central harness member securing inside marginal portions of the buoyancy means together and extending downward and terminating in a loop. A waist belt is slidably mounted in the loop and includes mating buckle parts. A neck strap is connected to the upper portion of the buoyancy means and has a buckle part attached thereto for mating with one of the buckle parts of the waist belt. One end of the waist belt is alternatively connectable to the other end of the waist belt for passing around the user's waist to secure the lower portion of the vest to the user's body, and it is alternatively connectable to the neck strap for passing between the user's legs to secure the lower portion of the vest to the body of a different size user. In the exemplary embodiment, much of the vest's support is about the neck of the user. The neck portion 23 fits tightly about the user's neck to support the head in an upright position and to prevent the vest from being removed from the user's head. However, it is advantageous to provide an auxiliary harness in order to secure the bottom portion of the vest to the lower part of the user's body and maintain a proper attitude of the body in the water.

The harness means includes a central harness member for webbing 81 which is secured to marginal portion 18 and, as shown in FIG. 7 of the exemplary embodiment, also serves to hold the adjacent sides of the marginal portion together so that the front and rear tube means assume a U-shaped configuration. The central harness member 81 terminates in a loop 82, and waist belt means 83 is slidably mounted in the loop. At either end of the waist belt are mating buckle parts 84 and 85. After the vest is put on the user, preferably prior to inflation, the waist belt is passed around the user's waist and the mating buckle parts are buckled together. Thereafter, the belt is tightened through the adjustment in one of the buckle parts.

If the vest were used on a child, the waist harness would be well below a small child's hips. Therefore, an auxiliary attachment means is provided. Because the waist belt is free to slide in the webbing, the webbing can be slid until the buckle 84 is adjacent the loop 82. Thereafter, the other end of the webbing is passed beneath the child's legs and up his back and connected to neck strap 86 with a buckle part 87 thereon which mates with buckle part 85. When the waist strap is tightened, the vest will be securely held to the body of the child. As mentioned above, the bending of the life vest about the light holder 40 facilitates in conforming the best to the user's body.

It will be understood that various modifications and changes may be made in the configuration of the life vest described above which may come within the spirit of this invention and all such changes and modifications coming within the scope of the appended claims are embraced thereby.

I claim:

1. In a life vest including buoyancy means to support the body of a person, gas supply means for supplying gas to the interior of the buoyancy means, the buoyancy means comprising front and rear tube means, each of the tube means having front and rear walls connected together along the marginal edges thereof in an airtight manner, the rear tube and the front tube being connected together, the buoyancy means having an inside marginal portion and an outside marginal portion, the improvement comprising:

the gas supply means comprising gas supply cartridge means for holding a given amount of gas under pressure and for releasing the gas into the tube means, the gas supply means further comprising oral delivery means for supplying an additional amount of gas to the tube means.

temporary connecting means on the tube means sufficiently strong to remain connected after release of the gas from said supply cartridge means holding corresponding sections of the tube means together after the supply cartridge means has released its said given amount of gas into the tube means, the buoyancy means having a first volume when the temporary connecting means is holding the corresponding sections of the tube means together after inflation by said given amount of gas from said gas supply cartridge means, the first volume of gas from the gas supply cartridge means providing sufficient buoyancy to support the body and filling said buoyancy means to less than the capacity it has after release of the temporary connecting means which releases the tube means, said tube means having a second volume greater than said first volume upon release of said temporary connecting means whereby additional gas may be supplied through the oral buoyancy means with a second volume to provide additional buoyancy to the body.

2. The improvement of claim 1 further including the provision of:

light holding means for holding an emergency light near the outside portion of said buoyancy means, fastening means near the outside marginal edge of both tube means for permanently fastening a section of said tube means together near the light holding means and for preventing said temporary connecting means from releasing the area near said light holding means so that the emergency light is retained within said light holding means when said temporary connecting means is released and whereby said tube means are bendable about said fastening means for enabling the life vest to better conform to the body of the user.

3. The improvement of claim 2 further including the provision of:

said light holding means including at least one pair of tabs, each tab formed integrally with one wall of each tube means, each tab having an aperture therethrough, said tabs being folded inwardly over each other so that the apertures are aligned for receiving said emergency light within the apertures of said tabs.

4. The improvement of claim 2 further including the provision of:

water activated battery means being activated when in water, means releasably holding said battery means on the vest, electrical current carrying means electrically connecting said battery means with said light, said electrical current carrying means being long enough so that when the means releasably holding the battery means is released, the battery falls into the water.

5. The improvement of claim 4 further including the provision of:

said means releasably holding said battery means comprising a pouch having an opened bottom for permitting the battery means to be removed therefrom, said pouch being of such a size that the battery means is held therein but may be removed by applying a given force, said battery means having a pair of holes therein, said pouch having a hole therethrough so located that said hole in the pouch is aligned with one of the holes in said battery means, and pulling means attached to said battery for pulling the battery from the pouch, said pulling means having two arms, each of said arms terminating in a plug, a first one of said arms extending inside said pouch, said plug on said first arm extending into one hole in the battery means, the other arm extending outside said pouch, the plug on said other arm extending through the aligned holes in the pouch and battery means to maintain the battery within said pouch whereby when said pulling means is pulled, the plug on said other arm is released from its holes to release said battery means and whereby said plug on said one of said arms pulling the battery means out of said pouch.

6. The improvement of claim 5 further comprising the provision of:

said holes in said battery means extending into the interior of the battery means for allowingthe entry of water into the battery to activate it.

7. The improvement of claim 5 further comprising the provision of:

said temporary connecting means including a plurality of snap means, each snap means including a male and female snap member, said snap members being fastened to outside marginal portions of the tube means, said pouch being mounted to the outside marginal portion of one tube means and held thereon by at least one snap member.

8. The improvement of claim 1 further comprising the inside marginal portion being formed of the inward extension of at least one wall of each of said tube means, oral delivery means having one end extending through one extension of said inside marginal portion and into the tube means associated with the other extension of the inside marginal portion whereby introduction of air into the oral delivery means inflates the tube means.

9. The improvement of claim 8 further comprising slit means in said inside marginal portion for receiving the other end of the oral delivery means to maintain the oral delivery means in a location where it does not interfere with donning of the life vest and where it is near the mouth of the person.

10. The improvement of claim 1 further comprising the provision of:

harness means including a central harness member securing inside marginal portions of the buoyancy means together and extending downward and terminating in loop means, waist belt means slidably mounted in said loop means and including mating buckle part, and neck strap means connected to the upper portion of the buoyancy means and having a buckle part attached thereto for mating with one of said buckle parts of the waist belt means, one end of said waist belt being alternatively connectable to the other end of the waist belt for passing around the user's waist to secure the lower portion of the vest to the user's body and connectable to the neck strap means for passing between the user's legs to secure the lower portion of the vest to the body of a different size user.

* * * * *

UNITED STATES PATENT AND TRADEMARK OFFICE

CERTIFICATE OF CORRECTION

PATENT NO. : 4,060,867

DATED : December 6, 1977

INVENTOR(S) : David D. Miller

It is certified that error appears in the above-identified patent and that said Letters Patent are hereby corrected as shown below:

Column 1, line 3, change "1976" to - - 1974 - -. Column 3, line 22, change "holding" (second occurrence) to - - holds - -. Column 4, line 27, change "of" to - - or - -; line 31, after the word "that" insert - - in - -. Column 8, line 5, change "to" to - - in - -. Column 9, line 10, change "best" to - - vest - -. Column 10 (within claim 6), line 53, "allowingthe" should read - - allowing the --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*